US006293194B1

(12) United States Patent
Vrotacoe

(10) Patent No.: US 6,293,194 B1
(45) Date of Patent: Sep. 25, 2001

(54) METHOD AND APPARATUS FOR ADJUSTING THE CIRCUMFERENTIAL REGISTER IN A WEB-FED ROTARY PRINTING PRESS HAVING A PLATE CYLINDER WITH A SLEEVE-SHAPED PRINTING PLATE

(75) Inventor: James Brian Vrotacoe, Rochester, NH (US)

(73) Assignees: Heidelberg Harris Inc., Dover, NH (US); Heidelberger Druckmaschinen AG, Heidelberger (DE)

( * ) Notice: Subject to any disclaimer, the term of this patent is extended or adjusted under 35 U.S.C. 154(b) by 736 days.

(21) Appl. No.: 08/646,077

(22) Filed: May 7, 1996

(51) Int. Cl.[7] ..... B41F 13/48; B41F 1/34; B41F 21/12; B41F 21/14

(52) U.S. Cl. ..... 101/248; 101/485

(58) Field of Search ..... 101/181, 248, 101/485

(56) References Cited

U.S. PATENT DOCUMENTS

| | | | | |
|---|---|---|---|---|
| 2,906,143 | | 9/1959 | Musser . | |
| 3,724,368 | | 4/1973 | Treff . | |
| 3,915,090 | * | 10/1975 | Horst et al. | 101/426 |
| 4,072,104 | * | 2/1978 | Schaffer | 101/248 |
| 4,473,009 | * | 9/1984 | Morgan | 101/232 |
| 4,484,522 | | 11/1984 | Simeth | 101/248 |
| 4,694,749 | * | 9/1987 | Takeuchi et al. | 101/426 |
| 4,709,634 | | 12/1987 | Momot et al. . | |
| 4,817,525 | | 4/1989 | Yagi | 101/219 |
| 4,903,597 | | 2/1990 | Hoage et al. . | |
| 4,913,048 | | 4/1990 | Tittgemeyer . | |
| 5,127,324 | * | 7/1992 | Palmatier et al. | 101/248 |
| 5,429,048 | | 7/1995 | Gaffney et al. . | |
| 5,492,059 | * | 2/1996 | Reichel | 101/375 |
| 5,551,339 | | 9/1996 | Schadlich et al. | 101/216 |

FOREIGN PATENT DOCUMENTS

| | | | |
|---|---|---|---|
| 0 693 374 A1 | 1/1996 | (EP) | B41F/13/004 |

OTHER PUBLICATIONS

MicroTrak CCR Operator's Manual, Web Printing Controls Co., Incorporated, Jan. 1990.

* cited by examiner

*Primary Examiner*—Kimberly L. Asher
(74) *Attorney, Agent, or Firm*—Burns, Doane, Swecker & Mathis, LLP

(57) ABSTRACT

A method and an apparatus for adjusting the circumferential register in a web-fed rotary printing press having a plate cylinder with a sleeve-shaped printing plate. Exemplary embodiments include a variable speed drive box which is controlled by a central control unit in dependence on a measured difference between the speed of a plate sleeve and the press speed. The drive box produces a slight overspeed of a plate cylinder body used to support the sleeve-shaped printing plate, such that a difference between the speed of the plate sleeve and the speed of the printing press is reduced to zero.

19 Claims, 2 Drawing Sheets

METHOD AND APPARATUS FOR ADJUSTING THE CIRCUMFERENTIAL REGISTER IN A WEB-FED ROTARY PRINTING PRESS HAVING A PLATE CYLINDER WITH A SLEEVE-SHAPED PRINTING PLATE

BACKGROUND OF THE INVENTION

1. Field of the Invention

The present invention relates to a method and device for printing, and more particularly, it relates to a method and apparatus for adjusting a circumferential register in a web-fed rotary printing press having a plate cylinder with a sleeve-shaped printing plate.

2. State of the Art

Printing presses have included mechanisms for circumferentially adjusting one cylinder of the press relative to another cylinder. In web-fed rotary presses, such adjustments are usually used in conjunction with a plate cylinder to circumferentially adjust the position of the plate cylinder relative to the corresponding blanket cylinder, whereby the blanket cylinder is, for example, driven by the main drive motor of the press via a common driving shaft. In perfecting blanket-to-blanket presses, such a circumferential adjustment provides for correct registry of the images printed on both sides of the web. In multi-color presses, such a circumferential register adjustment provides for the registry of images which are printed in one printing unit with a first color and images which are printed in a second printing unit with a second color.

In prior art web-fed rotary printing presses using conventional printing plates mounted to the plate cylinders of the presses, the circumferential register adjustment of each plate cylinder is achieved by a helical spline or by a helical gear which is axially moveable on the journal of the plate cylinder as described, for example, in U.S. Pat. No. 4,709,634, the contents of which are hereby incorporated by reference in their entirety. Besides the circumferential register adjustment, the apparatus of U.S. Pat. No. 4,709,634 further allows a lateral register adjustment of the plate cylinder. However, because the axial movement of the helical gear on the journal of the plate cylinder is limited, the angle of rotation of the plate cylinder is limited. Accordingly, the circumferential register can only be adjusted within a limited range.

Known printing units use continuous printing plates in the form of sleeves which are moved onto the plate cylinder through an opening formed in one side wall of the housing of the printing unit, while the plate cylinder is cantilevered in the other side wall of the housing. In these printing units, the sleeve-shaped printing plates tend to creep on the plate cylinder body when the printing press is in operation. A printing press using sleeve-shaped printing plates is, for example, described in U.S. Pat. No. 4,913,048, the contents of which are hereby incorporated by reference in their entirety.

The creeping of the sleeve-shaped printing plates causes a constant misregistering of the respective printing unit. Accordingly, attempts have been made to eliminate the creeping of the sleeve-shaped or tubular printing plates by pinning or fixing the plate form to the respective plate cylinder body. As the sleeve-shaped printing plates are usually manufactured from light duty conventional plate material, such as aluminum, the so formed printing plates tend to break or crack when they are fixed to the plate cylinder body by pins, because the material is not strong enough to withstand the forces trying to rotate the printing plate on the plate cylinder body.

SUMMARY OF THE INVENTION

Having outlined the state of the art and its disadvantages, it is accordingly an object of the present invention to provide a method of adjusting the circumferential register in a web-fed rotary printing press having at least one printing unit for receiving a sleeve-shaped printing plate.

It is another object of the present invention to provide an apparatus for adjusting the circumferential register in a web-fed rotary printing press having at least one plate cylinder for receiving and supporting a sleeve-shaped printing plate.

Exemplary embodiments of the present invention have the advantage that the adjustment of the circumferential register is performed continuously while the printing press is in operation. It is a further advantage of the present invention that the adjustment of the circumferential register is not limited to a certain angular range. In addition, the circumferential register adjustment of the present invention is performed automatically and requires no further actions of the press operator.

BRIEF DESCRIPTION OF THE DRAWINGS

Further objects, advantages and features of the present invention will be apparent to those skilled in the art to which it relates from the following detailed description of preferred embodiments thereof, made with reference to the accompanying drawings forming a part of this specification in which.

DETAILED DESCRIPTION OF THE PREFERRED EMBODIMENTS

Figure 1:
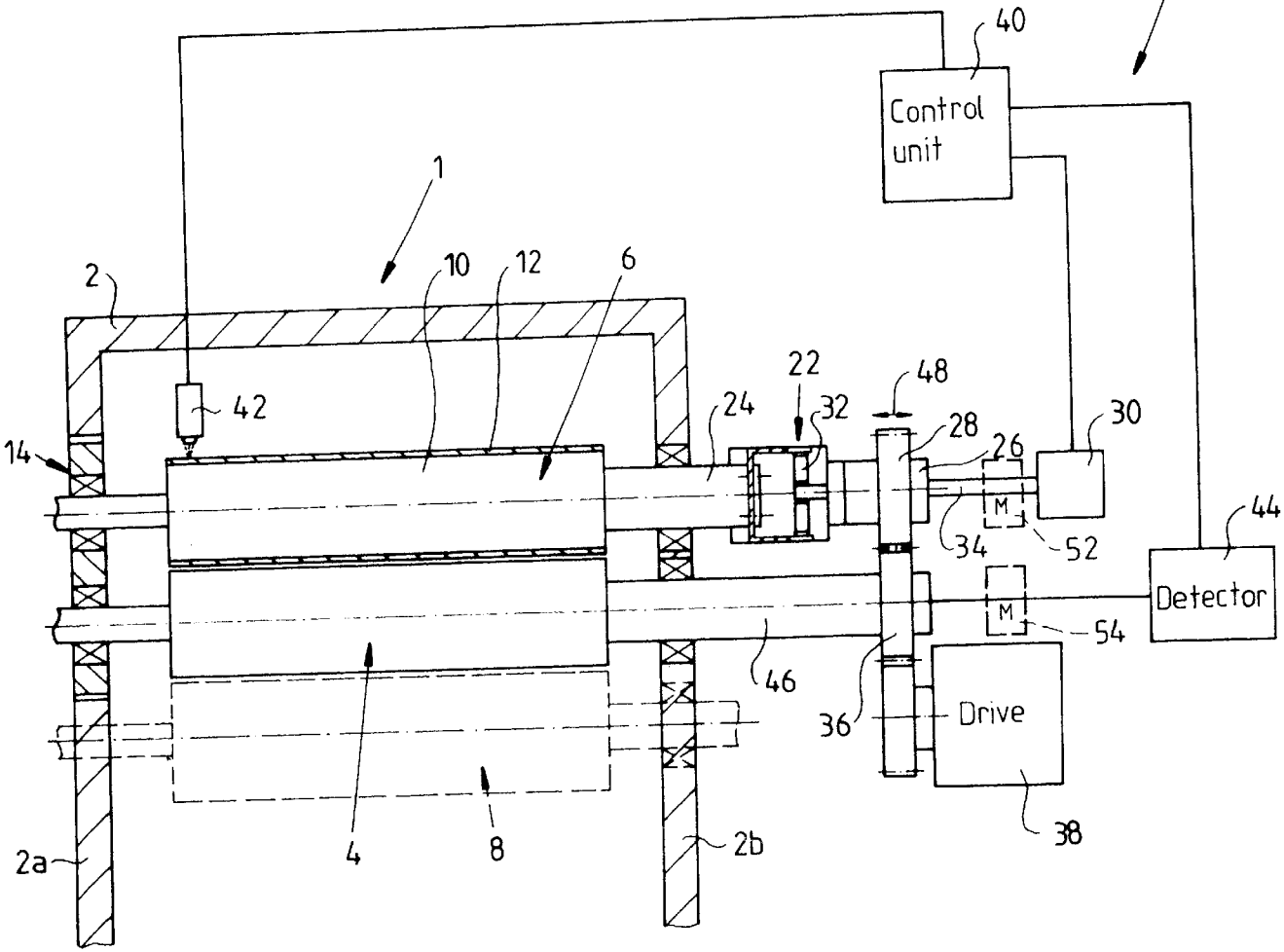
FIG. 1 is a schematic cross-sectional view of a printing unit with a blanket cylinder and an adjoining sleeve-shaped plate cylinder and a register adjustment system according to an exemplary embodiment of the present invention.

The printing unit 1 shown in FIG. 1 comprises a housing 2 in which a blanket cylinder 4 and an adjoining or corresponding plate cylinder 6 are rotatably supported by bearings and respective journals formed at each side of the blanket cylinder 4 and the plate cylinder 6. Underneath the blanket cylinder 4, a further cylinder 8 can be rotatably mounted in the housing 1. The cylinder 8 can either be an impression cylinder or, in the case of a perfecting blanket-to-blanket press, a second blanket cylinder, which corresponds to an adjoining plate cylinder not shown in the drawings. The plate cylinder 6 includes a plate cylinder body 10 on which a sleeve-shaped printing plate 12 is mounted. The printing plate 12 can, for example, be formed of a conventional printing plate by bending the plate to a sleeve and connecting the end portions of the plate by welding, by means of glue or adhesive, or in any other manner. Alternately, the printing plate can be formed from a seamless tube, to which the image is transferred afterwards.

The sleeve-shaped printing plate 12, also referred to herein as a plate sleeve, is mounted to and supported on the plate cylinder body 10 by moving the printing plate 12 sideward onto the plate cylinder body 10 through an opening 14 formed in the left side wall 2*a* of the housing 2 of the printing unit. When sliding the printing plate 12 onto the plate cylinder body 10, the plate cylinder 6 is cantilevered in the right sidewall 2*b* of the housing 2 of the printing unit, as described, for example, in U.S. Pat. No. 4,913,048, the contents of which are hereby incorporated by reference in their entirety. In order to provide for a safe and secure mounting of the printing plate 12 on the plate cylinder body 10, the inner diameter of the plate sleeve 12 is slightly smaller than the outer diameter of the plate cylinder body 10.

To mount the plate sleeve 12 onto the plate cylinder body 10, the sleeve is expanded by compressed air which is supplied by air nozzles (not shown) mounted in a circumferential surface of the plate cylinder body 10, when moving the plate sleeve 12 onto the plate cylinder body 10. When the compressed air is switched off, the plate sleeve 12 is clamped to the plate cylinder body 10. Such a feature is described in U.S. Pat. No. 4,903,597 and in U.S. Pat. No. 4,913,048, the disclosures of which are hereby incorporated by reference in their entireties.

Although the clamping of the plate sleeve 12 provides for a relatively tight and secure mounting of the plate sleeve, the plate sleeve 12 can rotate relative to the plate cylinder body 10, thereby causing a constant misregistering of the printing unit 1, when the printing unit is in operation. The speed with which the plate sleeve 12 is creeping or rotating on the plate cylinder body 10 depends on the press speed and can, for example, be one rotation per day when the press is running at a speed of about 80,000 revolutions per hour. The speed of the relative rotation between the plate cylinder body 10 and the plate sleeve 12 depends on various factors, such as the press speed, the temperature of the cylinders, the surface structure of the plate cylinder body 10, the surface structure of the plate sleeve 12, the blanket material on the blanket cylinder 4, the force by which the plate cylinder 6 and the blanket cylinder 4 are pressed against each other, the plate material, the different clamping forces of the sleeve to the cylinder and so forth.

In order to compensate for the constant misregistering of the printing unit 1 caused by the creeping plate sleeve 12, there is provided a dynamic circumferential register adjustment system 20. The dynamic register adjustment system 20 comprises a variable speed drive box 22 which is, in an exemplary embodiment of the invention, a harmonic drive as described, for example, in U.S. Pat. No. 3,724,368 or in U.S. Pat. No. 2,906,143, the contents of which are hereby incorporated by reference in their entireties. The variable speed drive box 22 drivingly interconnects the driving shaft or journal 24 of the plate cylinder 6 with a shaft 26 to which a helical drive gear 28 is axially movably connected. The variable speed drive box 22 provides for a small speed difference between the shaft 26 and the driving shaft 24 of the plate cylinder 6 and provides for a very fine and precise adjustment of this speed difference. The variable speed drive box 22 can, for example, be operated electrically by a stepping motor 30, an electric motor which rotates a wave-generator 32 of the variable speed drive box 22 via, for example, a shaft 34 extending through the center of the shaft 26, or any other motive force. When the shaft 34 is rotated, the variable speed drive box 22 generates a speed difference between the shaft 26 and the shaft or journal 24 of the plate cylinder 6, so that the plate cylinder body 10 is driven with a slightly increased speed with respect to the shaft 26 which is driven at press speed. The shaft 26 is driven by the plate cylinder gear 28 which is in meshing engagement with the blanket cylinder gear 36, the blanket cylinder gear 36 being, for example, driven at press speed by the main drive 38 of the printing press.

For controlling the speed of the plate cylinder body 10, the dynamic register adjustment system 20 comprises a central control unit 40 which controls the speed and the direction of rotation of the stepping motor 30. The central control unit 40 is further electrically connected to a first detector 42 which can be mounted adjacent to the surface of the plate sleeve 12. The first detector 42 can be a sensor, such as an optical sensor which senses marks (for example, the register marks generally represented as element 50 in FIG. 2, which are provided on the side of a printing plate for the usual static circumferential and/or lateral register adjustment). However, the detector 42 is not limited to the detection of register marks, but could also be a detector for detecting a certain area within the image provided on the printing plate or could be an electrically, magnetically or mechanically operated sensor, or any other suitable sensor.

A second detector 44 for measuring the speed of the printing press is connected to the central control unit 40. The second detector 44 can be, for example, a commonly available angular encoder which is connected to the drive shaft 46, or journal, of the blanket cylinder 4 and which supplies a signal to the central control unit 40 which corresponds to the speed of the printing press or printing unit 1. An angular encoder can be employed when, for example, using a continuous sleeve-shaped blanket cylinder as described, for example, in U.S. Pat. No. 5,429,048, the contents of which are hereby incorporated by reference in their entirety. As described therein, the sleeve shaped blanket cylinder is mounted to the blanket cylinder body in the same way as the plate sleeve 12 is mounted to the plate cylinder body 10. Thus, the sleeve-shaped blanket cylinder also creeps on the blanket cylinder body while the printing press is in operation.

Figure 2:
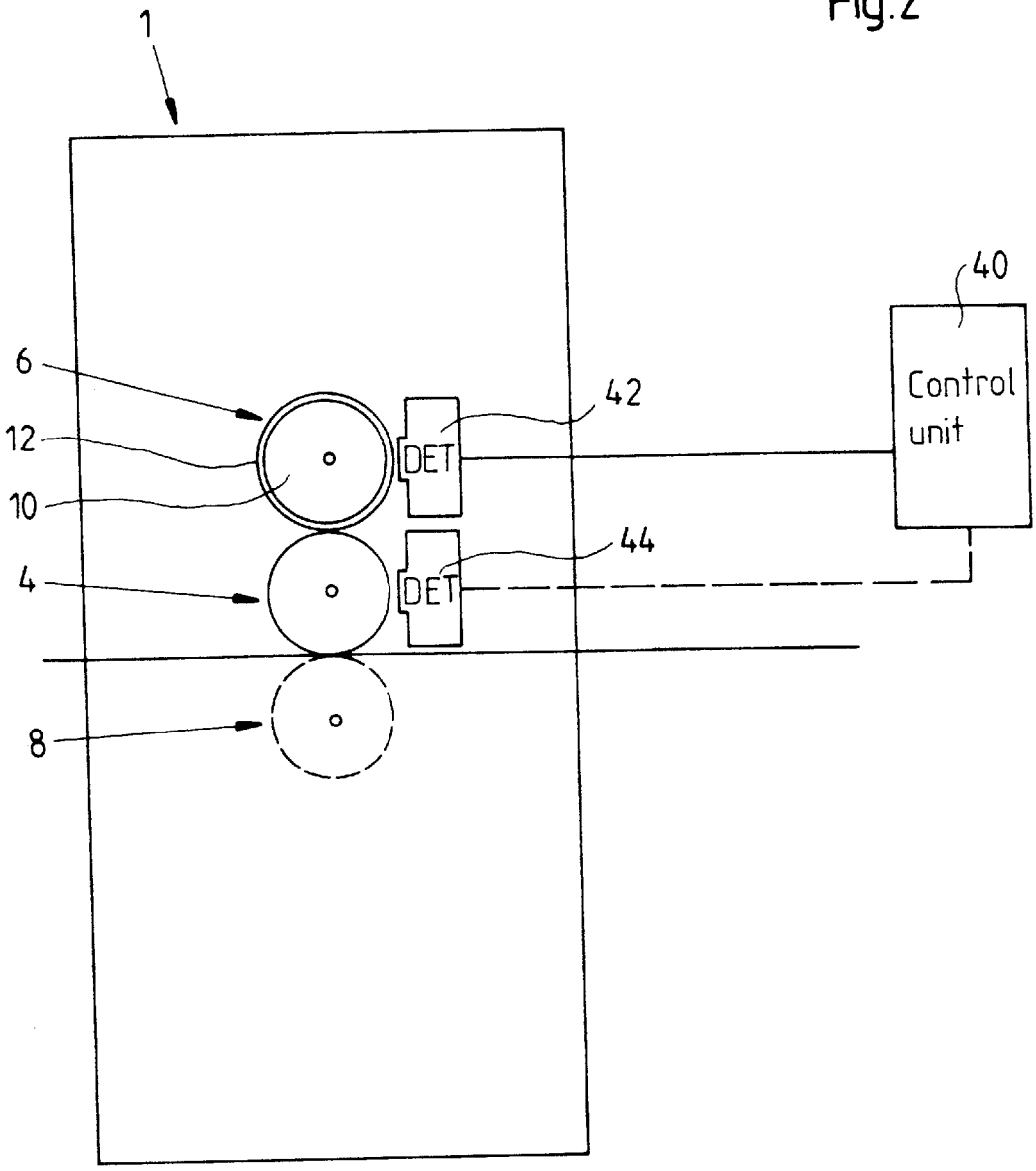
FIG. 2 is a schematic side view of the printing unit of FIG. 1, in which the speed of the blanket cylinder is detected by an optical detector 44 and respective marks on the blanket cylinder.

As shown in FIG. 2, the second detector 44 can also be an optical detector which, in the same way as the first detector 42, optically senses marks provided on the blanket cylinder 4. In another embodiment of the invention the second detector 44 can also be provided at, for example, the main drive of the printing press, another printing unit, the central driving shaft of the printing press or at any other possible location where the speed of the printing press can be measured. The second detector 44 is not limited to an optical detector, but can also be an electrically, magnetically or mechanically operated sensor, or any other suitable sensor.

The first and second detectors 42, 44 provide a first and a second signal, respectively which correspond to the speed of the plate sleeve 12 and the speed of the printing press or printing unit 1, respectively. The first and second signals are evaluated by the central control unit 40. The central control unit 40 generates a control signal for the stepping motor 30 of the variable speed drive box 22 in dependence on the speed difference between the speed of the plate sleeve 12 measured by the first detector 42 and the speed of the printing press measured by the second detector 44. The central control unit 40 controls the stepping motor 30 such that the variable speed drive box 22 produces a slight overspeed of the plate cylinder body 10, whereby the speed difference between the speed of the plate sleeve 12 measured by the first detector 42 and the speed of the printing press measured by the second detector 44 can be regulated (for example, minimized and/or reduced to zero).

The hardware used for the central control unit 40 and the first and second detectors 42, 44 can be, for example, a commonly available register control system or controlling the static circumferential and lateral register in a web-fed rotary printing press. Such a system is manufactured and sold by, for example, Web Printing Controls Co. Incorporated, 23872 N. Kelsey Road, Lake Barrington, Ill. 60010-1563, and is used in the printing presses of the M3000 series available from Heidelberger Druckmaschinen AG of Heidelberg, Germany. The control system of the above-mentioned manufacturer is described in an operating manual entitled "Micro Track CCR" (January 1990), available from Web Printing Controls Co., the contents of which are hereby incorporated by reference into this application.

Additionally, there can also be provided a commonly used static lateral and circumferential register adjustment system, such as the system described in U.S. Pat. No. 4,709,634, the contents of which are hereby incorporated by reference in their entirety, for controlling the static lateral and circumferential register independently of the abovementioned dynamic circumferential register adjustment. In FIG. 1, the static circumferential register adjustment of the plate cylinder 6 is represented by the double arrow 48 to schematically indicate the static circumferential register adjustment of the plate cylinder 6 by axially moving the helical gear 28 on the shaft 26, thereby rotating the shaft 26 with respect to the drive shaft 46 of the blanket cylinder 4.

The speed signals provided by the first and second detectors 42, 44 can be in the form of an absolute speed, such as the surface speed of the plate sleeve 12 and/or blanket cylinder 4, and/or can be in the form of an angular speed, such as the angular speed of the shaft 46 of the blanket cylinder 4 and/or can be in the form of signals corresponding to time differentiated position signals and/or to the time difference between two subsequent detections of a mark on the plate cylinder 12 and/or on the blanket cylinder 4. Variations and alternate types of speed signals suitable in connection with exemplary embodiments described herein will be apparent to those skilled in the art.

For example, the signals can also be of the form that measures the relative positions of locations on the plate sleeve and a reference (such as the line shaft or blanket cylinder). The velocity can be changed to keep these two locations in the same position every revolution.

In printing units in which each cylinder is separately driven by a respective motor, such as by using direct drive electric motors generally represented by direct drive motors 52 and 54 shown as dotted lines in FIG. 1, the above-described dynamic register adjustment can be performed as described above, or can be performed by directly controlling the relative speed of the motors. For example, dynamic register adjustment can be achieved by driving the plate cylinder 6 or plate cylinders via the central control unit 40. In this case, a variable speed drive box 22 is not necessary. Similarly, the gears 28 and 36 are not necessary.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Method for adjusting the circumferential register in a web-fed rotary printing press having a plate cylinder with a sleeve-shaped printing plate, comprising the steps of:

determining a speed difference between a speed of the sleeve-shaped printing plate and a speed of the press; and controlling a speed of a plate cylinder body which supports the sleeve-shaped printing plate to reduce said speed difference.

2. Method according to claim 1, further comprising a step of:

determining the speed of the sleeve-shaped printing plate by detecting register marks on the sleeve-shaped printing plate.

3. Method according to claim 2, wherein said step of detecting the register marks on the sleeve-shaped printing plate is performed optically.

4. Method according to claim 2, wherein said step of determining the speed of the sleeve-shaped printing plate includes a step of:

indirectly measuring a time difference between two subsequent detections of a register mark.

5. Method according to claim 1, further comprising a step of:

determining the speed of the press by an angular encoder.

6. Method according to claim 5, wherein said step of determining the speed of the press further includes a step of:

connecting the angular encoder to a blanket cylinder corresponding to said plate cylinder.

7. Method according to claim 1, further comprising a step of:

determining the speed of the press by detecting register marks on a body of a blanket cylinder corresponding to said plate cylinder.

8. Method according to claim 7, wherein said step of detecting the register marks on the body of the blanket cylinder is performed optically.

9. Method according to claim 7, wherein said step of determining the speed of the press further includes a step of:

determining a time difference between two subsequent detections of a register mark on the body of the blanket cylinder.

10. Method according to claim 1, further comprising a step of:

determining a speed of a blanket cylinder corresponding to said plate cylinder by differentiating a measured position signal.

11. Apparatus for adjusting a circumferential register in a web-fed rotary printing press having a plate cylinder with a sleeve-shaped printing plate, the apparatus comprising:

a first detector for detecting a speed of a sleeve-shaped printing plate;

a second detector for detecting a speed of a printing press; and a speed controller for controlling a speed of a body of a plate cylinder which supports said sleeve-shaped printing plate in dependence on a speed difference of the speeds measured by the first detector and second detector to reduce the speed difference.

12. Apparatus according to claim 11, wherein the first detector is an optical detector for detecting register marks located on the sleeve-shaped printing plate.

13. Apparatus according to claim 12, wherein said first detector determines the speed of the sleeve-shaped printing plate indirectly by measuring a time difference between two subsequent detections of a register mark.

14. Apparatus according to claim 11, wherein the second detector is an angular encoder connected to a body of a blanket cylinder which corresponds to said plate cylinder.

15. Apparatus according to claim 11, wherein the second detector is an optical detector which detects marks located on a blanket cylinder which corresponds to said plate cylinder.

16. Apparatus according to claim 15, wherein the marks on the blanket cylinder are detected optically.

17. Apparatus according to claim 15, wherein the second detector determines the speed of the press indirectly by measuring a time difference between two subsequent detections of a mark on the blanket cylinder.

18. Apparatus according to claim 11, wherein the speed controller further includes:

a harmonic drive connected to the plate cylinder.

19. Apparatus according to claim 11, wherein the speed controller further includes:

individual drive motors for separately driving each cylinder of said printing press.

* * * * *